US008152406B1

(12) United States Patent
Al-Qahtani

(10) Patent No.: US 8,152,406 B1
(45) Date of Patent: Apr. 10, 2012

(54) CRASH BARRIER WITH OVER-PRESSURE RELIEF SYSTEM

(75) Inventor: Bandar Ali Al-Qahtani, Riyadh (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 12/941,580

(22) Filed: Nov. 8, 2010

(51) Int. Cl.
*E01F 13/04* (2006.01)

(52) U.S. Cl. ..... 404/6; 60/403; 60/415

(58) Field of Classification Search ..... 60/368, 60/403, 415; 404/6; 49/31, 49; 256/13.1
See application file for complete search history.

(56) References Cited

U.S. PATENT DOCUMENTS

| | | | | |
|---|---|---|---|---|
| 2,553,045 | A | 5/1951 | Jaseph et al. | |
| 3,916,624 | A | 11/1975 | Machens et al. | |
| 4,490,068 | A * | 12/1984 | Dickinson | 404/6 |
| 4,627,763 | A | 12/1986 | Roemer et al. | |
| 4,711,608 | A * | 12/1987 | Ghusn | 404/6 |
| 4,818,136 | A * | 4/1989 | Nasatka et al. | 404/6 |
| 4,850,737 | A * | 7/1989 | Nasatka et al. | 404/6 |
| 4,893,119 | A * | 1/1990 | Nasatka | 340/928 |
| RE33,201 | E * | 4/1990 | Dickinson | 404/6 |
| 5,469,703 | A | 11/1995 | Ericsson et al. | |
| 5,680,760 | A | 10/1997 | Lunzman | |
| 6,250,202 | B1 | 6/2001 | Buttner et al. | |
| 6,901,754 | B2 | 6/2005 | Jervis | |
| 7,165,950 | B2 | 1/2007 | Fenny et al. | |
| 7,264,417 | B1 | 9/2007 | Nasatka | |

OTHER PUBLICATIONS

PCT/US2011/055802, International Search Report and Written Opinion dated Nov. 7, 2011, 7 pages.

* cited by examiner

*Primary Examiner* — Gary S Hartmann
(74) *Attorney, Agent, or Firm* — Abelman, Frayne & Schwab

(57) ABSTRACT

A crash barrier system is provided that generally includes a hydraulic actuator driven piston operably connected to a hydraulic circuit and the crash barrier. In general, the hydraulic circuit includes a normal-UP and normal-DOWN section, an emergency-UP section, and an external pressure relief valve. In order to automatically provide corrective action in the event of an overpressure condition, the external pressure relief valve is connected to the hydraulic circuit. Upon occurrence of condition that causes the hydraulic fluid pressure to exceed a predetermined value, hydraulic fluid is released through the pressure relief valve to maintain the pressure at or below the predetermined value.

13 Claims, 9 Drawing Sheets

CRASH BARRIER WITH OVER-PRESSURE RELIEF SYSTEM

RELATED APPLICATIONS

Not applicable.

BACKGROUND OF THE INVENTION

1. Field of the Invention

This invention relates to hydraulic powered vehicle crash barrier systems, in particular crash vehicle barrier systems having an emergency mode of operation to rapidly raise the crash barrier.

2. Description of Related Art

Vehicle crash barriers are well known for use as anti-terrorism and other security measures. Generally, a crash barrier pivots between a lowered position in which vehicles easily pass over it, and a raised position that prevents passage of vehicles. In order to sustain an impact from a potential vehicular threat, the barriers have substantial mass and are constructed of very heavy gauge steel, and may include concrete.

In order to raise the barrier rapidly, the mechanisms required are typically over-engineered. Examples of mechanisms to raise and lower the barrier based on hydraulics are described, for instance, in U.S. Pat. Nos. 4,850,737, 4,627,763, and 4,490,068, all of which are incorporated by reference herein.

Under normal conditions, rapid deployment of the barrier into its raised position is not necessary. Therefore, hydraulic circuits for barriers have been designed to include a normal-UP mode of operation, a normal-DOWN mode of operation, and an emergency-UP mode of operation. In one example of the system described herein, the normal-UP and normal-DOWN modes of operation, the hydraulic piston raises the barrier typically between about 3 and 5 seconds, and lowers the barrier typically between about 6 and 8 seconds. When a threat is imminent or perceived, the emergency-UP mode of operation is used, enabling the barrier to be raised in about 1 to about 1.5 seconds. For instance, such a system including an emergency-UP mode of operation is described in various product literature and is commercially available from Nasatka Barrier Incorporated of Clinton, Md., USA.

However, problems associated with the hydraulic circuit can result in periods of inoperability of the barrier system. Systems that raise and lower the crash barriers are prone to failure, for instance in the form of hydraulic fluid overpressure that exceed the capacity of various valves, seals or other elements in the fluid pathway.

A hydraulic actuator is generally a sealed cylinder having a pair of variable volume fluid compartments with individual inlet/outlet ports. Under normal operating conditions, hydraulic fluid is pumped from a reservoir into one of the variable volume fluid compartments (a high pressure compartment), thereby displacing the piston and causing the crash barrier to ascend or descend. Hydraulic fluid from the other variable volume fluid compartment (a low pressure compartment) is expelled into the reservoir. However, certain undesirable conditions may cause hydraulic fluid from a high pressure compartment of the hydraulic actuator to leak into the low pressure compartment and into the hydraulic circuit, which will be referred to as an internal leak.

Furthermore, various control valves are in line between the pump and the hydraulic actuator, including a multi-port, multi-position directional control valve (e.g., a sandwich valve) that switches between conduits under control of a solenoid. If the solenoid valve is defective, any resulting overpressure conditions may cause failure in the directional control valve, system hoses, or one or more pressure gauges connected to at various positions in the hydraulic circuit.

In addition, a pressure switch is coupled to a programmable logic controller in order to ascertain the pressurization status of one or more hydraulic fluid lines. The pressure switch is disposed in a hydraulic fluid path between the directional control valve and one of the inlet/outlet ports of the hydraulic actuator (typically the compartment that raises the crash barrier upon increased pressurization due to introduction of hydraulic fluid). This pressure switch is prone to failure, which diminishes control functionality of the programmable logic controller, potentially leading to overpressure conditions that may cause damage to elements in the hydraulic fluid circuit.

If the maximum pressure capacity of any of the system components is exceeded, one or more external leaks can occur, thus wasting hydraulic fluid, potentially creating environmental problems, and, of course, rendering the crash barrier inoperable during the time it takes to make the necessary repairs. If the failure occurs in the raised position, that creates an inconvenience for the normal traffic flow in and out of the facility. If the failure occurs in the lowered position, the facility is left vulnerable to vehicular threats.

Therefore, a need exists for a system and method that overcomes the deficiencies of existing vehicle crash barrier hydraulic circuits.

Accordingly, it is an object of the present invention to provide a pressure relief sub-system that compensates for overpressure conditions in hydraulic circuits that control the vehicle crash barrier.

It is another object of the present invention to provide a pressure relief sub-system that includes an alternate path for pressurized fluid, preventing or minimizing damage to components including the hydraulic actuator, valves, pressure gauges, and other components of the hydraulic system.

It is still another object of the present invention to provide a pressure relief sub-system that recycles hydraulic fluid, even during overpressure conditions.

SUMMARY OF THE INVENTION

The above objects and further advantages are provided by the system and process for improving operations of crash barriers having emergency modes of operation. A crash barrier system is provided that generally includes a hydraulic actuator driven piston operably connected to a hydraulic circuit and the crash barrier. In general, the hydraulic circuit includes a normal-UP and normal-DOWN section, an emergency-UP section, and an external pressure relief valve.

The hydraulic actuator driven piston includes a first end structurally connected to the crash barrier and a second end that is a movable compartment wall between a first variable volume fluid compartment and a second variable volume fluid compartment. The first variable volume fluid compartment includes an associated hydraulic fluid port, and the second variable volume fluid compartment includes an associated hydraulic fluid port. An increase in the fluid pressure in the first variable volume fluid compartment by introduction of hydraulic fluid causes therein via the first hydraulic fluid port applies pressure against the movable compartment wall and displaces the piston, causing the crash barrier to move to the DOWN position. An increase in the fluid pressure in the second variable volume fluid compartment by introduction of hydraulic fluid causes therein via the second hydraulic fluid port displaces the movable compartment wall and displaces the piston, causing the crash barrier to move to the UP position.

The normal-UP and normal-DOWN section of the hydraulic circuit includes various components to displace the piston, including a directional control valve, a hydraulic fluid pump in fluid communication with a hydraulic fluid reservoir, and associated hydraulic lines and other components.

The directional control valve, which can be a sandwich valve or any other suitable arrangement of valves and actuators, is constructed and arranged in the fluid paths between the hydraulic fluid ports of the hydraulic actuator compartments via two valve ports, and the pump and the hydraulic fluid source reservoir via two additional valve ports. In particular, the directional control valve includes a first directional control valve port associated with a first fluid line to direct fluid to or from the first hydraulic actuator compartment, a second directional control valve port associated with a second fluid line to direct fluid to or from the second hydraulic actuator compartment, a third directional control valve port as a pressurized fluid inlet in fluid communication with the hydraulic fluid pump; and a fourth directional control valve port as a drainage outlet in fluid communication with the hydraulic fluid reservoir.

By operation of a solenoid or other suitable controllable structure and arrangement, the directional control valve has various conduit arrangements including:

a first conduit arrangement in which pressurized hydraulic fluid is passed from the pump through a pressurized fluid delivery line and the third directional control valve port, the first directional control valve port, the first fluid line and into the first hydraulic fluid port of the first variable volume fluid compartment, and drained hydraulic fluid is passed from the second variable volume fluid compartment via second fluid line through the second directional control valve port and into the hydraulic reservoir via the fourth directional control valve port and a hydraulic fluid drain line;

a second conduit arrangement in which pressurized hydraulic fluid is passed from the pump through the pressurized fluid delivery line and the third directional control valve port, the second directional control valve port, the second fluid line and into the second hydraulic fluid port of the second variable volume fluid compartment, and drained hydraulic fluid is passed from the first variable volume fluid compartment via the first fluid line through the first directional control valve port and into the hydraulic reservoir via the fourth directional control valve port and the hydraulic fluid drain line; and, in certain embodiments, a third conduit arrangement in which the first directional control valve port and the second directional control valve port are closed (or the third directional control valve port and the fourth directional control valve port are closed, or all four of the ports of the directional control valve are closed) to prevent backflow of hydraulic fluid from the first fluid line and the second fluid line into the hydraulic fluid reservoir.

Therefore, to raise the crash barrier under normal-UP conditions, the directional control valve sub-system is configured in the second conduit arrangement, so that the pump pressurizes and delivers hydraulic fluid into the second variable volume fluid compartment and thereby displace the piston, which causes return of hydraulic fluid from the first variable volume fluid compartment to the hydraulic fluid reservoir. To lower the crash barrier under normal-DOWN conditions, the directional control valve sub-system is configured in the first conduit arrangement, so that the pump pressurizes and delivers hydraulic fluid into the first variable volume fluid compartment and thereby displace the piston, which causes return of hydraulic fluid from the second variable volume fluid compartment to the hydraulic fluid reservoir.

The crash emergency barrier rise sub-system is in fluid communication with the second fluid line associated with the second hydraulic fluid port of the second variable volume compartment via an accumulator line. The crash emergency barrier rise sub-system includes an emergency hydraulic fluid line having a recharged state in which hydraulic fluid is maintained at a pressure greater than the pressure of hydraulic fluid in the accumulator line, a pressurized vessel containing hydraulic fluid and compressed gas, and an emergency-UP solenoid check valve connected between the emergency hydraulic fluid line and the accumulator line. The emergency-UP solenoid check valve has an open position in which higher pressure hydraulic fluid from the recharged hydraulic fluid line passes to the accumulator line, and a closed position in which either the recharged hydraulic fluid in the emergency hydraulic fluid line is isolated from the accumulator line, or hydraulic fluid in the accumulator line passes to the emergency hydraulic fluid line to attain the recharged state, i.e., to build up the pressure of hydraulic fluid in the pressurized vessel after an emergency-UP operation. In addition, an emergency sub-system accumulator drain valve is provided, which is conventionally used to release excess hydraulic fluid from the emergency hydraulic fluid line, and, according to the present invention, its use can be limited to depressurizing the system for system calibration. Further, a hydraulic pressure gauge is connected to the emergency hydraulic fluid line between the emergency-UP solenoid check valve and the pressurized vessel, and allows a system operator to monitor the pressure in the emergency hydraulic fluid line. In the event that the pressure is below a certain level that is required to perform an emergency-UP operation, corrective action is taken in order to recharge the emergency hydraulic fluid line. Further, as described below, if the pressure in the in the emergency hydraulic fluid line is above a predetermined level, the external pressure relief valve will release the excess pressure to maintain the pressure in the emergency hydraulic fluid line is above a predetermined level at or below the predetermined level.

The system further includes a programmable logic controller in electronic communication with the directional control valve (e.g., via the solenoid or other suitable controllable apparatus), the hydraulic fluid pump and the emergency-UP solenoid check valve. Accordingly, when the crash barrier is to be displaced to the UP position or the DOWN under normal conditions, a signal is sent from the programmable logic controller to the directional control valve to open one of the conduits between the pressurized fluid delivery line and the appropriate port of the hydraulic actuator, and to the hydraulic pump (or its associated motor) to deliver pressurized hydraulic fluid. When the crash barrier is to be displaced to the UP position under crash emergency conditions, the programmable logic controller sends a signal to the emergency-UP solenoid check valve to open, thereby allowing pressurized hydraulic fluid from the emergency hydraulic fluid line and the pressurized vessel to supplement the pressure in the second fluid line and rapidly displace the piston and thus raise the crash barrier.

In order to automatically provide corrective action in the event of an overpressure condition, an external pressure relief valve is connected to the hydraulic circuit in fluid communication with the emergency hydraulic fluid line. In certain embodiments, the external pressure relief valve is a three port valve in which two ports are connected the hydraulic pressure gauge and the pressurized vessel, and the third port is a relief port. Further, in certain embodiments, the relief port of the external accumulator relief valve drains excess hydraulic fluid directly to the hydraulic reservoir. Upon occurrence of condition that causes the hydraulic fluid pressure in the emergency hydraulic fluid line to exceed a predetermined value, hydraulic fluid is released through the pressure relief valve to maintain the pressure in the emergency hydraulic fluid line at or below the predetermined value.

BRIEF DESCRIPTION OF THE DRAWINGS

The invention will be described in further detail below and with reference to the attached drawings in which the same or similar elements are referred to by the same number, and where.

DETAILED DESCRIPTION OF THE INVENTION

Figures 1A, 1B:
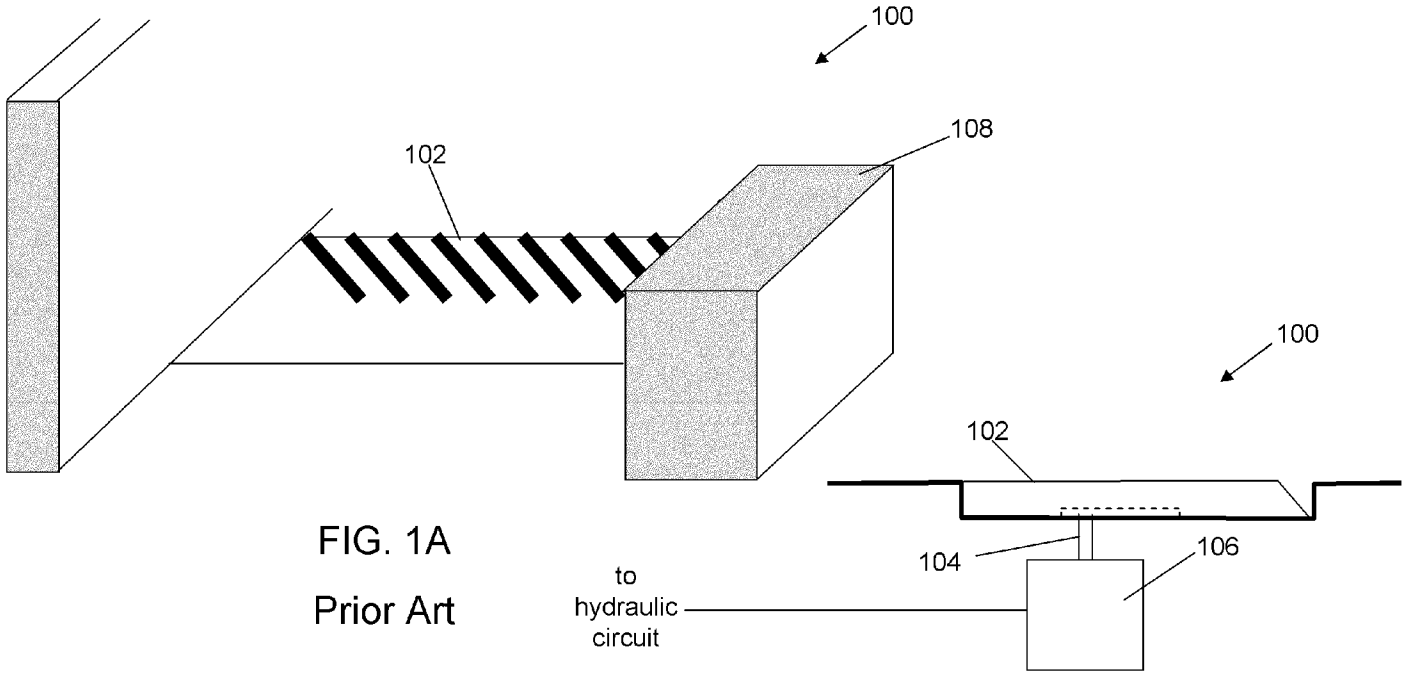
FIG. 1A Prior Art
FIG. 1B Prior Art
FIG. 1A shows a perspective view of a simplified crash barrier in the DOWN position.
FIG. 1B shows a sectional view of the simplified crash barrier of FIG. 1A.
Figures 2A, 2B:
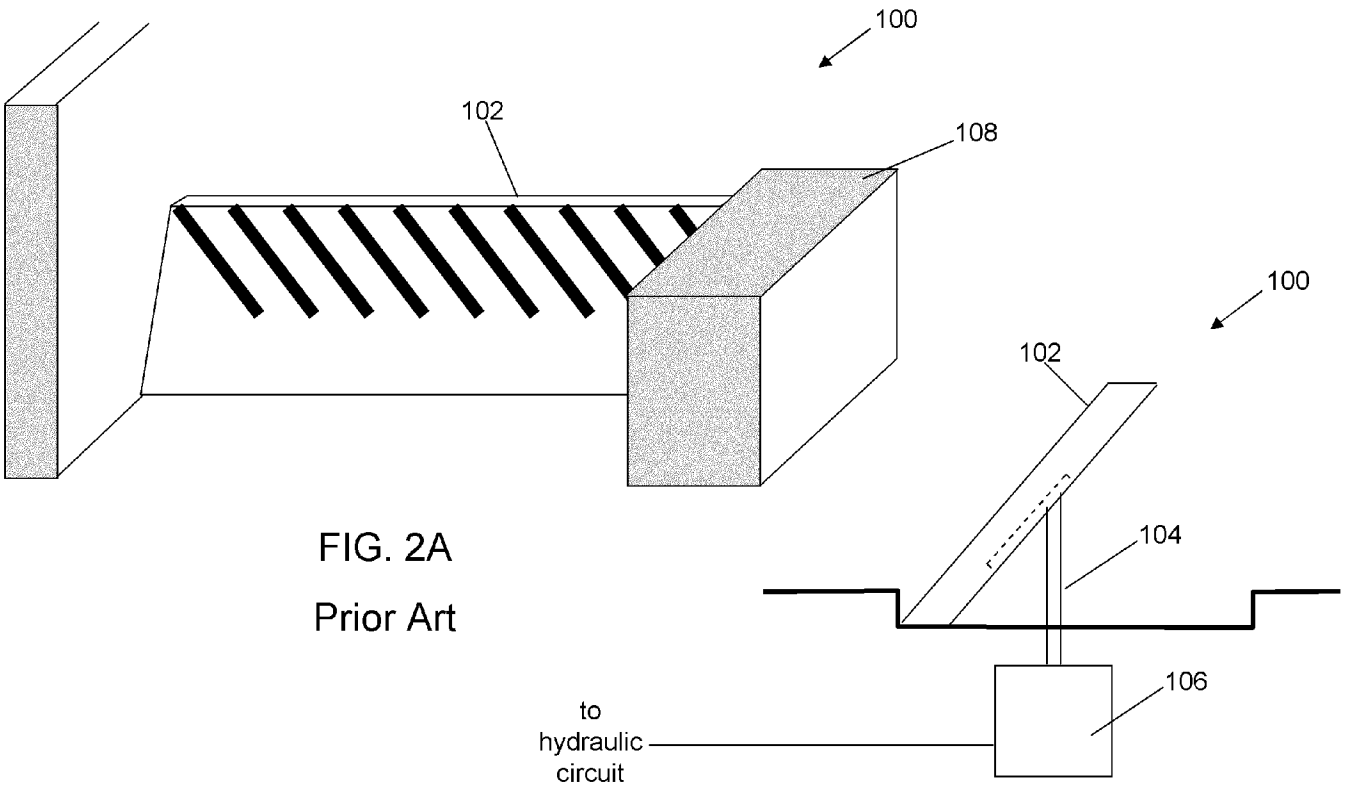
FIG. 2B Prior Art
FIG. 2A Prior Art
FIG. 2A shows a simplified perspective view of a crash barrier in the UP position.
FIG. 2B shows a sectional view of the crash barrier of FIG. 2A.

FIGS. 1A and 1B show a simplified perspective view and a sectional view of a typical prior art crash barrier system 100 having a barrier 102 in the DOWN position, and FIGS. 2A and 2B show perspective views of system 100 having the barrier 102 in the UP position. The system 100 includes the barrier 102 operably connected to a hydraulically driven piston 104 of an actuator 106. All or a portion of a hydraulic circuit for powering the lifting and retracting operations of the barrier 102 can be encased, for instance, in a housing 108.

Figure 3:
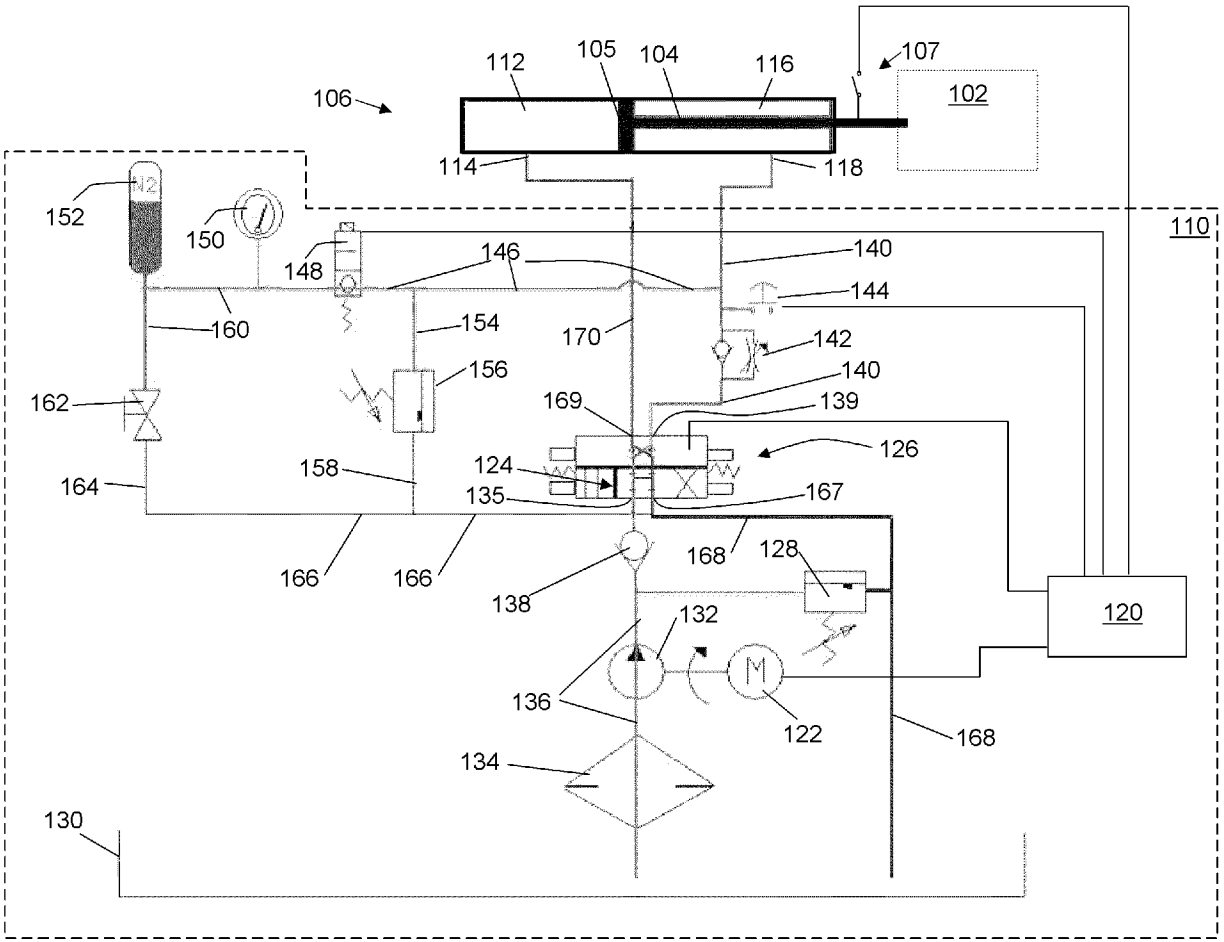
FIG. 3 Prior Art
FIG. 3 is a schematic illustration of a conventional hydraulic circuit for operating a crash barrier.

Referring to FIG. 3, a conventional hydraulic circuit 110 is schematically illustrated in fluid communication with the piston 104 of the hydraulic actuator 106. The hydraulic actuator 106 driven piston 104 includes a first end structurally connected to the crash barrier 102 and a second end that is a movable compartment wall 105 between a first variable volume fluid compartment 112 and a second variable volume fluid compartment 116. The first variable volume fluid compartment 112 includes an associated hydraulic fluid port 114, and the second variable volume fluid compartment 116 includes an associated hydraulic fluid port 118. An increase in the fluid pressure in the first variable volume fluid compartment 112 by introduction of hydraulic fluid causes therein via the first hydraulic fluid port 114 displaces the movable compartment wall 105 and displaces the piston 104, causing the crash barrier 102 to move to the DOWN position. An increase in the fluid pressure in the second variable volume fluid compartment 116 by introduction of hydraulic fluid causes therein via the second hydraulic fluid port 118 displaces the movable compartment wall 105 and displaces the piston 104, causing the crash barrier 102 to move to the UP position.

For example, the hydraulic actuator 106 can operate at a pressure of about 1000 to about 1400 pounds per square inch (psi) from the hydraulic fluid pump 132, referred to as a "recharging pressure," to cause the piston 104 to impart sufficient force to raise the barrier 102 during normal-UP operations in about 3 to 5 seconds. A pressure of less than about 1400 psi is applied from the hydraulic fluid pump 132 to cause the piston 104 to impart sufficient force to lower the barrier 102 during normal-DOWN operations in about 6 to 8 seconds.

Certain components of circuit 110 are controlled by a programmable logic controller (PLC) 120. In particular, as shown in FIG. 3, PLC 120 is in electronic communication with a motor 122, an up/down solenoid directional control valve sub-system or assembly 126 (referred to herein as "directional control valve 126"), a pressure switch 144, an emergency-UP solenoid check valve 148 and a down limit switch 107 that is arranges to that it is in mechanical cooperation with the piston or the barrier when in the DOWN position such that when the barrier 102 is in the DOWN position, the down limit switch 107 will close and provide appropriate feedback to the PLC 120.

The directional control valve 126 is preferably one that can be readily controlled by the PLC 120, and provides four ports with three finite positions, i.e., two conduit arrangements to and from the source of hydraulic fluid to the hydraulic actuator 106, and one position in which all paths are blocked to prevent backflow. In addition, the directional control valve 126 can be adjustable to compensate for pressure variations in the hydraulic fluid.

For instance, in one embodiment, the directional control valve 126 includes a solenoid 124, a first path opening 169 in fluid communication with the first fluid line 170, a second path opening 139 in fluid communication with a second fluid line 140, a pressurized fluid inlet 135 in fluid communication with the hydraulic fluid pump 132 via a pressurized fluid delivery line 136, and a drainage outlet 167 in fluid communication with the hydraulic fluid reservoir 130 via a main system drain line 168. Connection of the main system drain line 168 to the directional control valve 126 is for the purpose of permitting backflow from the first fluid line 170 and the second fluid line 140. In particular, the directional control valve includes a first conduit arrangement, a second conduit arrangement and, in certain embodiments, a third conduit arrangement.

In the first conduit arrangement, pressurized hydraulic fluid generally from the pump 132 to the first variable volume fluid compartment 112, and from the second variable volume fluid compartment 116 to the hydraulic reservoir 130. In particular, pressurized hydraulic fluid is passed from the pump 132 through the pressurized fluid delivery line 136 and the third directional control valve port 135, the first directional control valve port 169, the first fluid line 170 and into the first hydraulic fluid port 114 of the first variable volume fluid compartment 112, and drained hydraulic fluid is passed from the second variable volume fluid compartment 116 via second fluid line 140 through the second directional control valve port 139 and into the hydraulic reservoir 130 via the fourth directional control valve port 167 and a hydraulic fluid drain line 168.

In the second conduit arrangement, pressurized hydraulic fluid generally from the pump 132 to the second variable volume fluid compartment 116, and from the first variable volume fluid compartment 112 to the hydraulic reservoir 130. In particular, pressurized hydraulic fluid is passed from the pump 132 through the pressurized fluid delivery line 136 and the third directional control valve port 135, the second directional control valve port 139, the second fluid line 140 and into the second hydraulic fluid port 118 of the second variable volume fluid compartment 116, and drained hydraulic fluid is passed from the first variable volume fluid compartment 112 via first fluid line 170 through the first directional control valve port 169 and into the hydraulic reservoir 130 via the fourth directional control valve port 167 and a hydraulic fluid drain line 168.

In the third conduit arrangement, the first directional control valve port 169 and the second directional control valve port 139 are closed to prevent backflow of hydraulic fluid from the first fluid line 170 and the second fluid line 140 into the hydraulic fluid reservoir 130. Alternatively, the third directional control valve port 135 and the fourth directional control valve port 167 can be closed. In further alternatives, all four of the ports of the directional control valve 126 can be closed.

While the directional control valve 126 is shown as a particular type of up/down solenoid directional control valve assembly, which can be implemented as a sandwich valve, one of ordinary skill in the art will appreciate that other arrangements of valves and actuators can be used to provide the functionality of the directional control valve 126. Accordingly, any suitable directional control valve sub-system can be employed.

Hydraulic fluid, stored in a reservoir 130, is pumped with the pump 132, activated by the motor 122 under control of the PLC 120, through an oil strainer 134 along the pressurized fluid delivery line 136. A check valve 138 is disposed between pump 132 and the pressurized fluid inlet 135 of the directional control valve 126 to prevent backflow of hydraulic fluid. A pump relief valve 128 has a maximum pressure setting, for instance, 1500 psi, in a system that operates as described herein with reference to FIGS. 3-6 for a crash barrier 102 that raises in a normal-UP mode in about 3 to 5 seconds, lowers in a normal-DOWN mode in about 6 to 8 seconds, and raises in an emergency-UP mode in about 1 to 1.5 seconds. When the pressure in the line to which pump relief valve 128 is connected reaches its maximum pressure setting, hydraulic fluid is released back into the hydraulic reservoir 130.

The second fluid line 140 is between the second port 139 of the directional control valve 126 and the second hydraulic fluid port 118 of the second variable volume fluid compartment 116. A down speed valve 142 for controlling the speed of the barrier while it is moving into the DOWN position, and the pressure switch 144, are provided along the second fluid line 140. The pressure switch 144 typically has a maximum pressure setting, for instance, 1400 psi in a system that operates as described herein with reference to FIGS. 3-6 for a crash barrier 102 that raises in a normal-UP mode in about 3 to 5 seconds, lowers in a normal-DOWN mode in about 6 to 8 seconds, and raises in an emergency-UP mode in about 1 to 1.5 seconds. Accordingly, when the pressure in line 140 reaches the maximum pressure setting, a signal is conveyed to the PLC 120 to stop the motor 122.

An accumulator line 146 is connected to the second fluid line 140 between pressure switch 144 and second hydraulic fluid port 118, and extends to the emergency-UP solenoid check valve 148. Line 146 also includes an accumulator branch 154 branching therefrom that connects to an accumulator relief valve 156 that serves to block or pass fluid to a relief branch 158. The accumulator relief valve 156 typically has maximum a pressure setting, for instance, 1700 psi in a system that operates as described herein with reference to FIGS. 3-6 for a crash barrier 102 that raises in a normal-UP mode in about 3 to 5 seconds, lowers in a normal-DOWN mode in about 6 to 8 seconds, and raises in an emergency-UP mode in about 1 to 1.5 seconds. One of ordinary skill in the art will understand that the maximum pressure settings for the pump relief valve 128, pressure switch 144 and the accumulator relief valve 156 may be increased or decreased depending on the requisite load and other factors.

A crash emergency barrier rise sub-system includes an emergency hydraulic fluid line 160, the emergency-UP solenoid check valve 148, a pressure gauge 150, a pressurized vessel 152, and an emergency sub-system accumulator drain valve 162. The emergency hydraulic fluid line 160 is connected to the emergency-UP solenoid check valve 148 on the side opposite of accumulator line 146 and includes the pressure gauge 150 and the pressurized vessel 152. The emergency-UP solenoid check valve 148 is arranged so that hydraulic fluid from the accumulator line 146 can pass through valve 148 when it is in the closed position, thereby pressurizing the emergency-UP pneumatic container 152. The emergency-UP pressurized vessel 152 is a vessel that, when the emergency-UP solenoid valve 148 is closed, contains hydraulic fluid under pressure of a compressed gas, such as a nitrogen cylinder. When the emergency-UP solenoid valve 148 is opened, the hydraulic fluid in the pressurized vessel 152 is displaced under pressure of the compressed gas along emergency hydraulic fluid line 160 to accumulator line 146, into second fluid line 140, and to the second fluid port 118, thereby displacing the piston 104 and causing the crash barrier 102 to rapidly rise. The compressed gas cylinder is replaced or recharged after an emergency event results in its depletion.

In other words, in an emergency condition, the PLC 120 sends an appropriate signal to the emergency-UP solenoid valve 148 to open and to release pressure accumulated in emergency hydraulic fluid line 160 as result of the pressure from the pressurized vessel 152. In addition, with the emergency solenoid valve 148 in the open position, the only available path for compressed gas, e.g., nitrogen, from the pressurized vessel 152 is sequentially through lines 160, 146 and into second fluid port 118. A pressure drop becomes apparent to one monitoring the pressure gauge 150 during activation of the emergency system.

Figure 4:
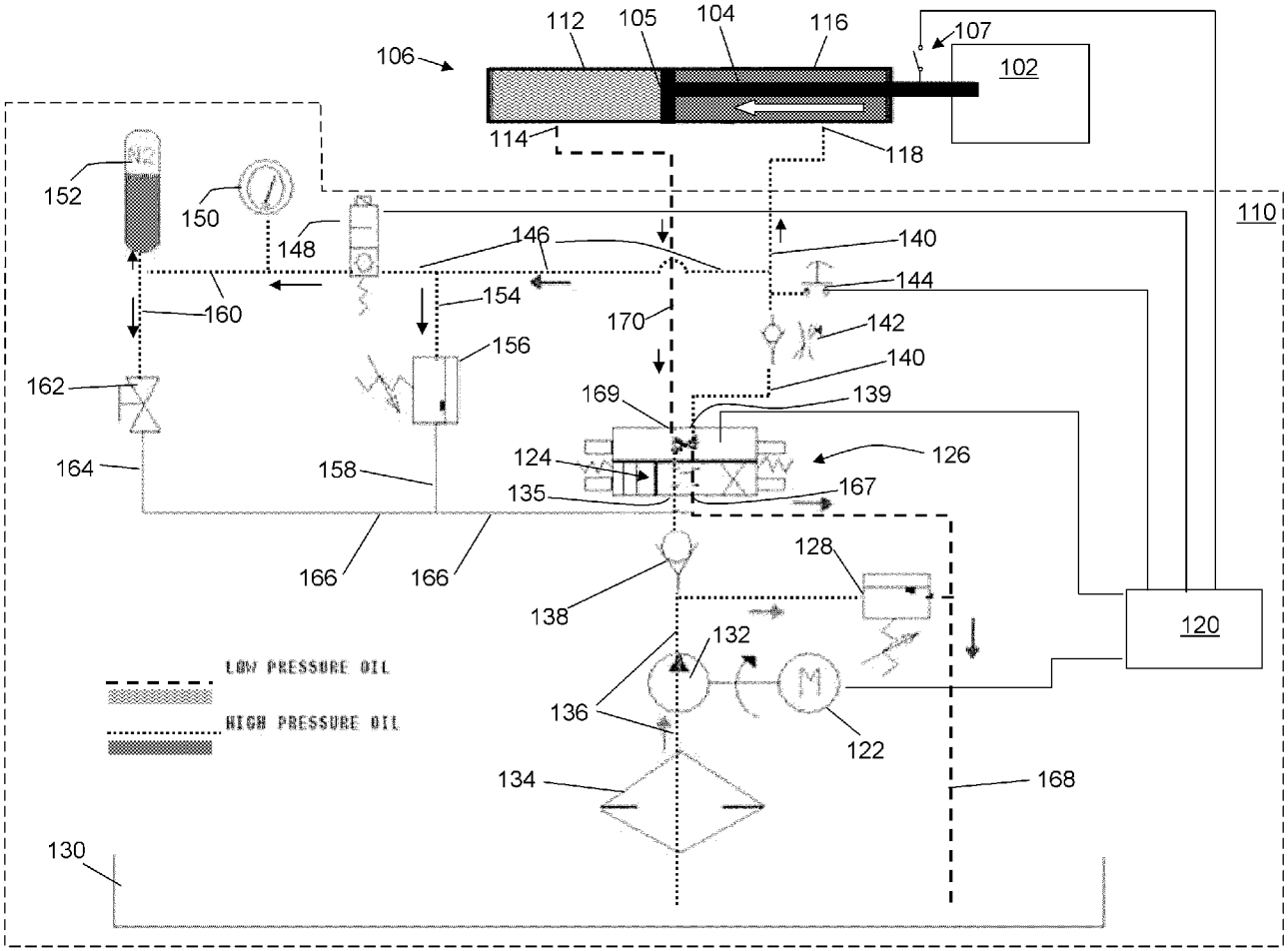
FIG. 4 Prior Art
FIG. 4 shows the hydraulic circuit of FIG. 3 during normal operation of raising the crash barrier.

Emergency hydraulic fluid line 160 is normally in fluid communication with the remainder of the hydraulic circuit only in the direction toward the pressurized vessel 152 due to the emergency-UP solenoid check valve 148. That is, hydraulic fluid in the accumulator line 146 passes to the emergency hydraulic fluid line 160 to attain the recharged state, i.e., to build up the pressure of hydraulic fluid in the pressurized vessel after an emergency-UP operation. For instance, as shown in FIG. 4, the arrows in emergency hydraulic fluid line 160 and the arrows in accumulator line 146 are directed towards the pressurized vessel 152 and the emergency sub-system accumulator drain valve 162, which indicate that the emergency-UP solenoid valve 148, when closed, is a point of isolation that prevents flow towards the hydraulic actuator 106.

However, when a signal is sent from the PLC 120 to the emergency-UP solenoid check valve 148 to open, accumulated pressure in line 160, derived from the pressurized vessel 152, is released into the accumulator line 146 and the second fluid line 140. When the emergency-UP solenoid check valve 148 is open, as in the condition shown in FIG. 6, the arrows in emergency hydraulic fluid line 160 and accumulator line 146 are shown directing pressure to the second hydraulic fluid port 118 of the second variable volume fluid compartment 116 to cause emergency-UP operation of the barrier 102.

Emergency hydraulic fluid line 160 also includes an emergency hydraulic fluid drain line 164 branching therefrom that receives drain fluid from the emergency sub-system accumulator drain valve 162. A collective drain line 166 receives drain fluid from relief branch 158 and emergency hydraulic fluid drain line 164, and connects to the main system drain line 168.

The conventional hydraulic circuit 110 includes various safety protection devices in an attempt to prevent overpressure conditions. These include the pressure switch 144, the PLC 120, which includes a built-in time delay, the accumulator relief valve 156, and the pump relief valve 128. However, it is known that these devices and associated measures are not failure-proof. For instance, in the event that pressure switch 144 is defective, the PLC 120 will not provide adequate control of overpressure conditions when the motor 122 is activated to start the pump 132. The pressure switch 144 is positioned in the circuit to control the pressure in the normal-UP operation and avoid excess pressure, for instance, in lines 140, 146.

FIGS. 4-8 show various modes of operation and conditions of the hydraulic circuit 110, where high pressure fluid lines are depicted with closely spaced square dots and components having high pressure fluid therein are shown with a closely spaced checkerboard pattern; low pressure fluid lines are depicted with dashed lines, and components having low pressure fluid therein are shown with a zig zag pattern; and lines with fluid leaks are depicted with dash-dot lines, and components having leaked fluids therein are shown with a dashed upward diagonal pattern.

Now referring to FIG. 4, in order to raise the crash barrier 102 under normal conditions, PLC 120 sends a start signal to motor 122 and a signal to directional control valve 126 to open the path to the second fluid line 140, i.e., the second conduit arrangement as described above. High pressure hydraulic fluid is directed along the pressurized fluid delivery line 136 through check valve 138, directional control valve 126 configured in the second conduit arrangement, second fluid line 140, and into the second hydraulic fluid port 118 of the second variable volume fluid compartment 116. High pressure fluid also passes to the accumulator line 146 and the emergency hydraulic fluid line 160 (through the closed emergency-UP solenoid check valve 148), and is maintained in lines 146, 160 by the accumulator relief valve 156 and the emergency hydraulic fluid drain valve 162. In particular, in the event that the emergency system has been recently used, during normal operations to raise the crash barrier 102, pressure in lines 146, 160 accumulates. This pressurized fluid applies pressure against the movable compartment wall 105 and displaces the piston 104 to the left as shown in FIG. 4, thereby increasing the volume of the second variable volume fluid compartment 116 and raising the crash barrier 102, and commensurately decreasing the volume of the first variable volume fluid compartment 112. At the same time, low pressure hydraulic fluid is discharged from the first hydraulic fluid port 114 along the first fluid line 170, through the directional control valve 126 configured in the second conduit arrangement, and to the main system drain line 168 for collection in the reservoir 130. In addition, the pressure from the hydraulic fluid in accumulator line 146 and the emergency hydraulic fluid line 160 serves to recharge hydraulic fluid associated with the emergency-UP pneumatic container 152. Under normal operations, in an example of the system described herein, the crash barrier is raised in about 3 to 5 seconds.

Figure 5:
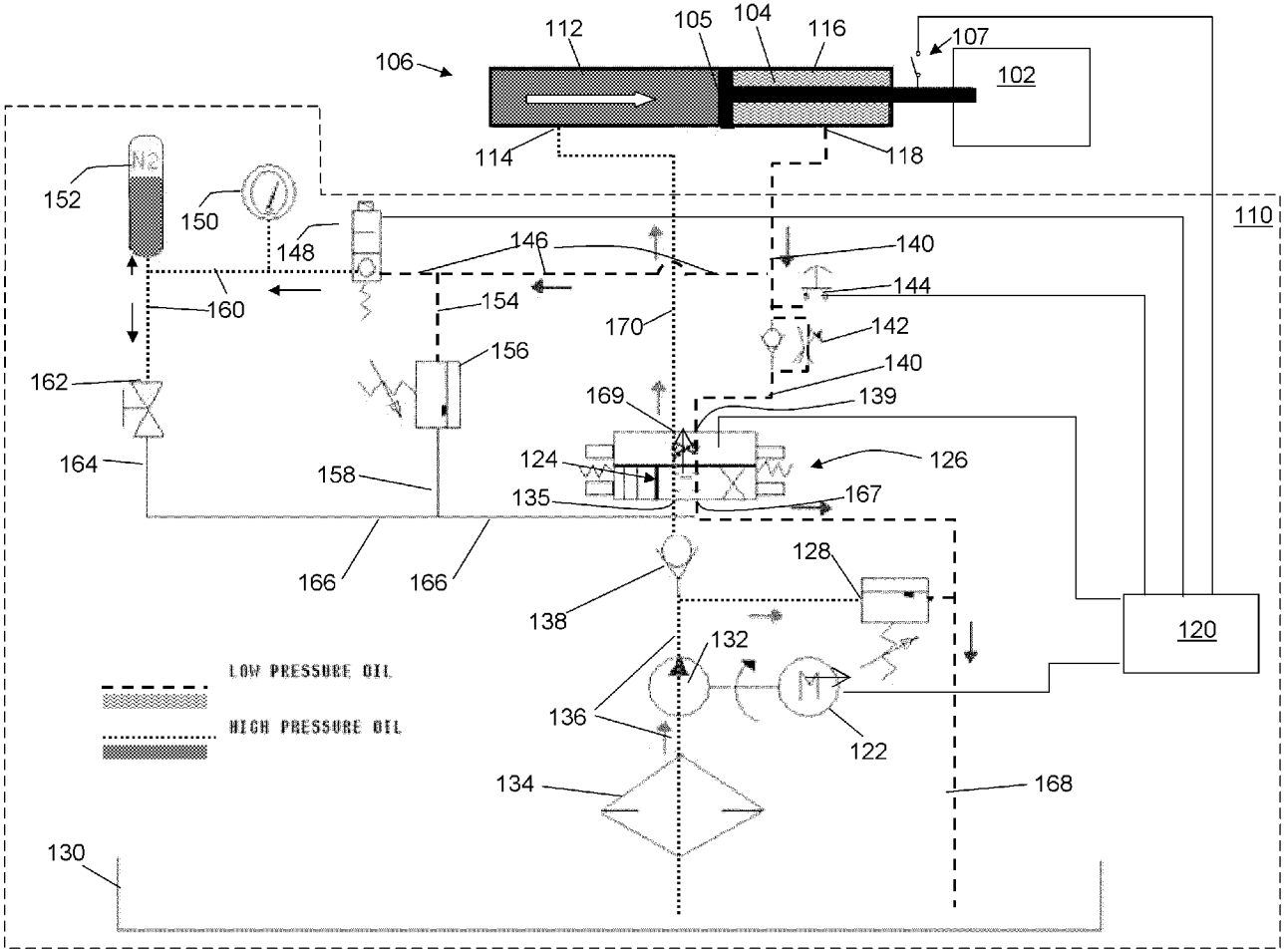
FIG. 5 Prior Art
FIG. 5 shows the hydraulic circuit of FIG. 3 during normal operation of lowering the crash barrier.

Now referring to FIG. 5, fluid flow during normal operations of closing the crash barrier 102 is depicted. PLC 120 sends a start signal to motor 122 to activate the hydraulic fluid pump 132, and a signal to directional control valve 126 to open the conduit to direct pressurized fluid to first fluid line 170, i.e., the first conduit arrangement as described above. High pressure hydraulic fluid is directed along line 136 through check valve 138, the directional control valve 126 configured in the first conduit arrangement, to first fluid line 170, and into the first hydraulic fluid port 114 of the first variable volume fluid compartment 112. This pressurized fluid applies pressure against the movable compartment wall 105 and displaces the piston 104 to the right as shown in the FIG. 5, thereby increasing the volume of the first variable volume fluid compartment 112 and lowering the crash barrier 102, and commensurately decreasing the volume of the second variable volume fluid compartment 116. Under normal operations, in an example of the system described herein, the crash barrier is lowered in about 6 to 8 seconds. At the same time, low pressure hydraulic fluid is discharged from fluid port 118, along second fluid line 140, through the directional control valve 126 configured in the first conduit arrangement, and to the main system drain line 168 for collection in the reservoir 130.

Figure 6:
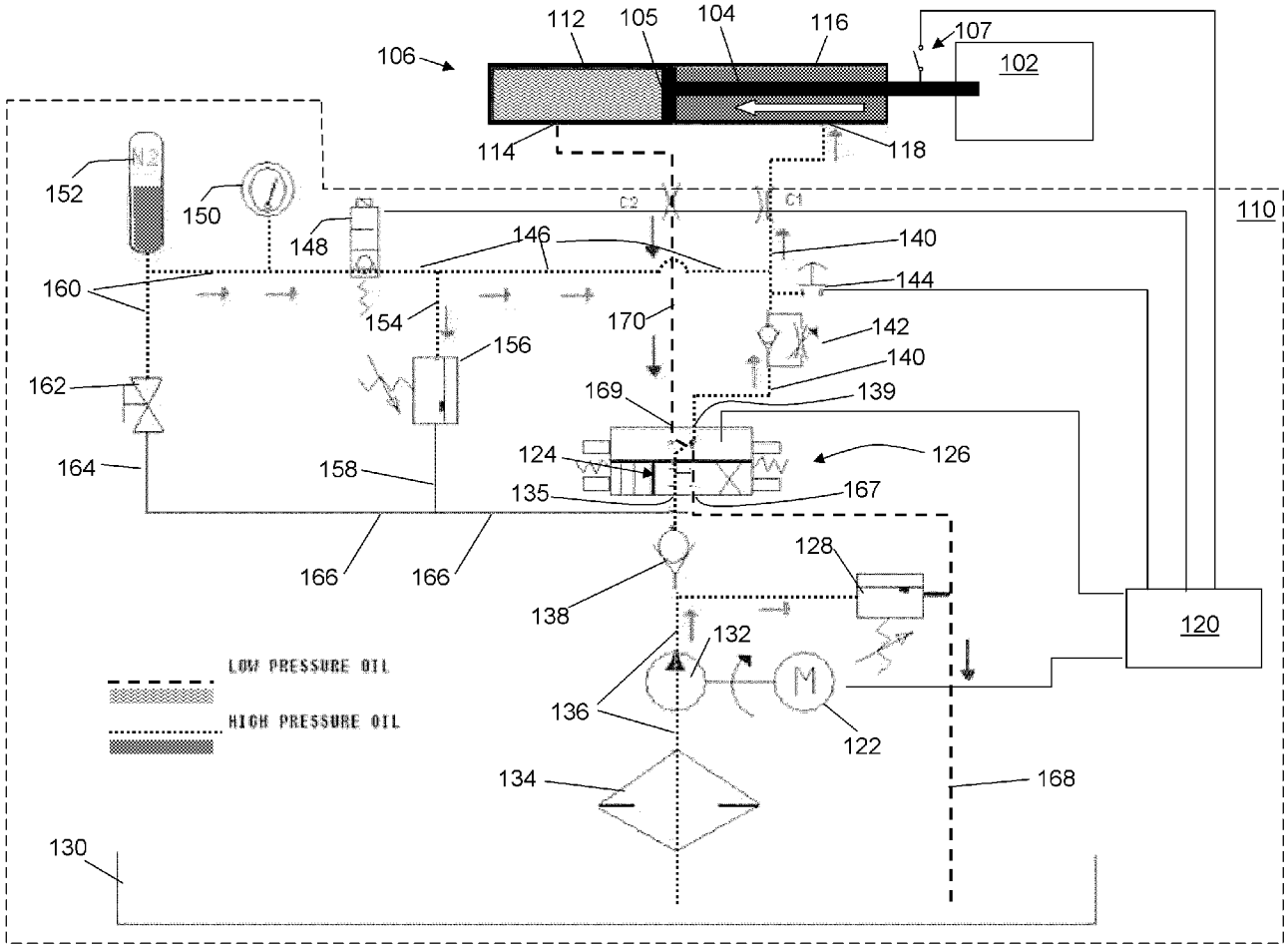
FIG. 6 Prior Art
FIG. 6 shows the hydraulic circuit of FIG. 3 during emergency operation of raising the crash barrier.

Referring now to FIG. 6, the emergency-UP mode of operation is shown. In one example of the system described herein, the range of pressure in emergency hydraulic fluid line 160 is between about 1400 psi to about 2000 psi, i.e., the final stage after recharging such that the system is ready to use the emergency-UP pneumatic container 152, for raising the barrier 102 in about 1 to 1.5 seconds. During normal operations, high pressure fluid is retained in emergency hydraulic fluid line 160 and bounded by the closed emergency-UP solenoid valve 148 and the closed emergency hydraulic fluid drain valve 162. During emergency-UP operations, the emergency-UP solenoid valve 148 is opened under control of the PLC 120, and the aggregate of the recharging pressure from the hydraulic fluid pump 132 in the lines 140, 146 (e.g., about 1000 to about 1400 psi in an example of the system described herein) and additional pressure from the emergency-UP pressurized vessel 152 (e.g., about 300 to about 500 psi from a compressed nitrogen cylinder in an example of the system described herein) causes the piston 104 to impart sufficient force to raise the barrier 102 in about 1 to 1.5 seconds. Pressurized vessel 152 can subsequently be recharged by adding a charged compressed gas cylinder.

Figure 7:
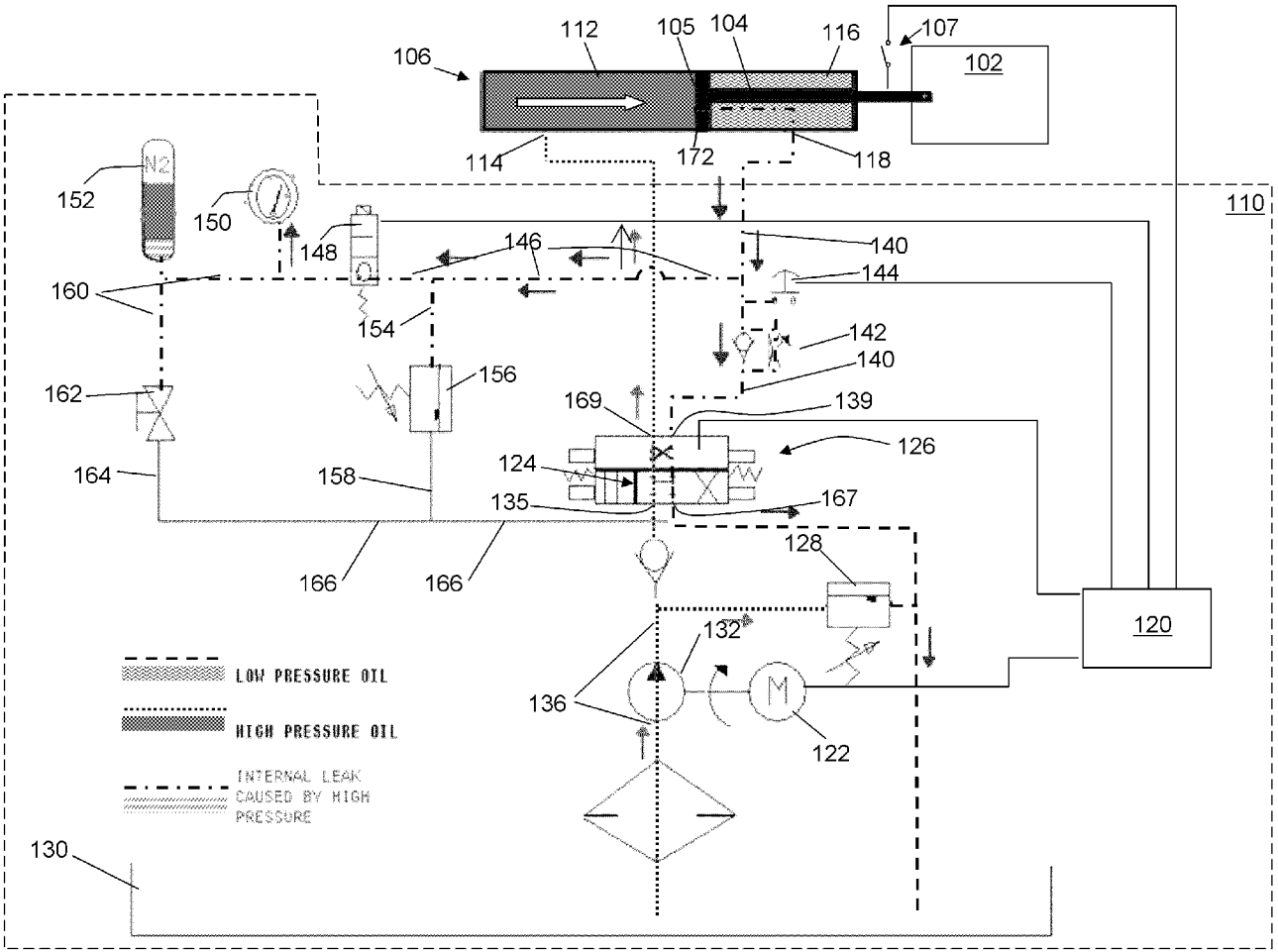
FIG. 7 Prior Art
FIG. 7 shows the hydraulic circuit of FIG. 3 under conditions of a fluid leak in the hydraulic actuator.

Referring now to FIG. 7, the hydraulic circuit 110 is depicted in a condition where there is excess pressure in the hydraulic actuator 106. For instance, in the normal-DOWN mode of operation, pressure in the first variable volume fluid compartment 112 can exceed the maximum pressure of the cylinder and cause an internal leak where high pressure fluid crosses into the second variable volume compartment 116. This is represented in FIG. 7 by line 172 between the first variable volume fluid compartment 112 and the second variable volume fluid compartment 116. The leaked fluid will further extend into the lines 140, 146 and 154. In addition, the leak can extend into the emergency hydraulic fluid line 160 and potentially into the emergency-UP pneumatic container 152 and the pressure gauge 150, which can cause faulty operation of the emergency-UP sub-system when its use is required, failure of the pressure gauge 150, or both.

Figure 8:
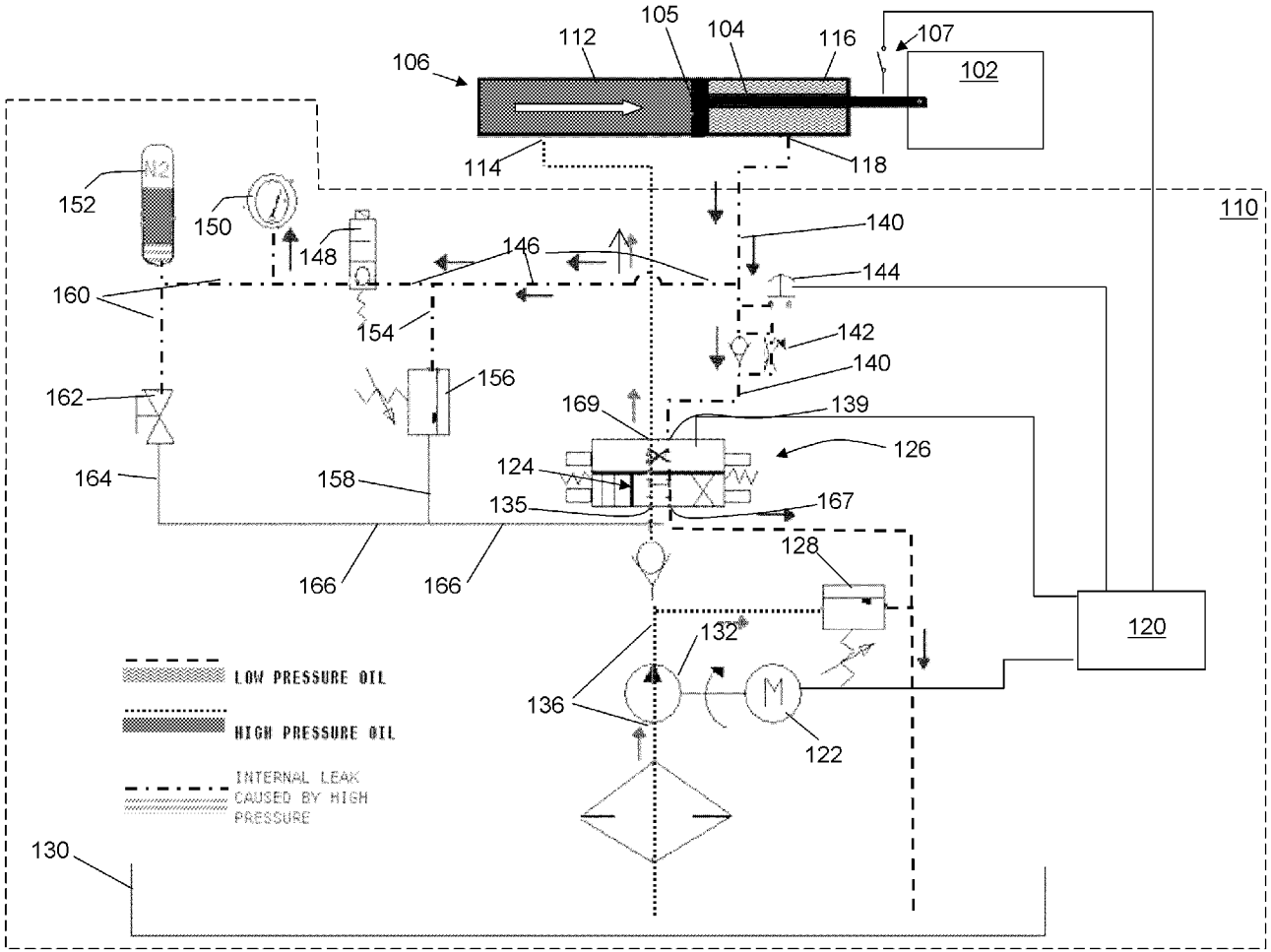
FIG. 8 Prior Art
FIG. 8 shows the hydraulic circuit of FIG. 3 under conditions of a defective the up-down solenoid causing an internal leak and external leaks.

Referring now to FIG. 8, the hydraulic circuit 110 is depicted in a condition where the directional control valve 126 is defective or blocked. In this situation, pressure will accumulate in the lines 140, 146, 154 and 160, in the pressure gauge, and/or within the emergency-UP pneumatic container 152. An external leak can occur at a weak point in the circuit, such as one or more gaskets in the directional control valve 126, or one or more of the hoses that form lines 140, 146 and 154.

In most overpressure conditions, it becomes necessary to depressurize the system through the drain valve 162 in order to prevent damage to components of the hydraulic circuit, thereby causing system downtime. This action is undesirable since the system is rendered inoperable and potential threats cannot be stopped with the barrier 102 during this downtime.

Figure 9:
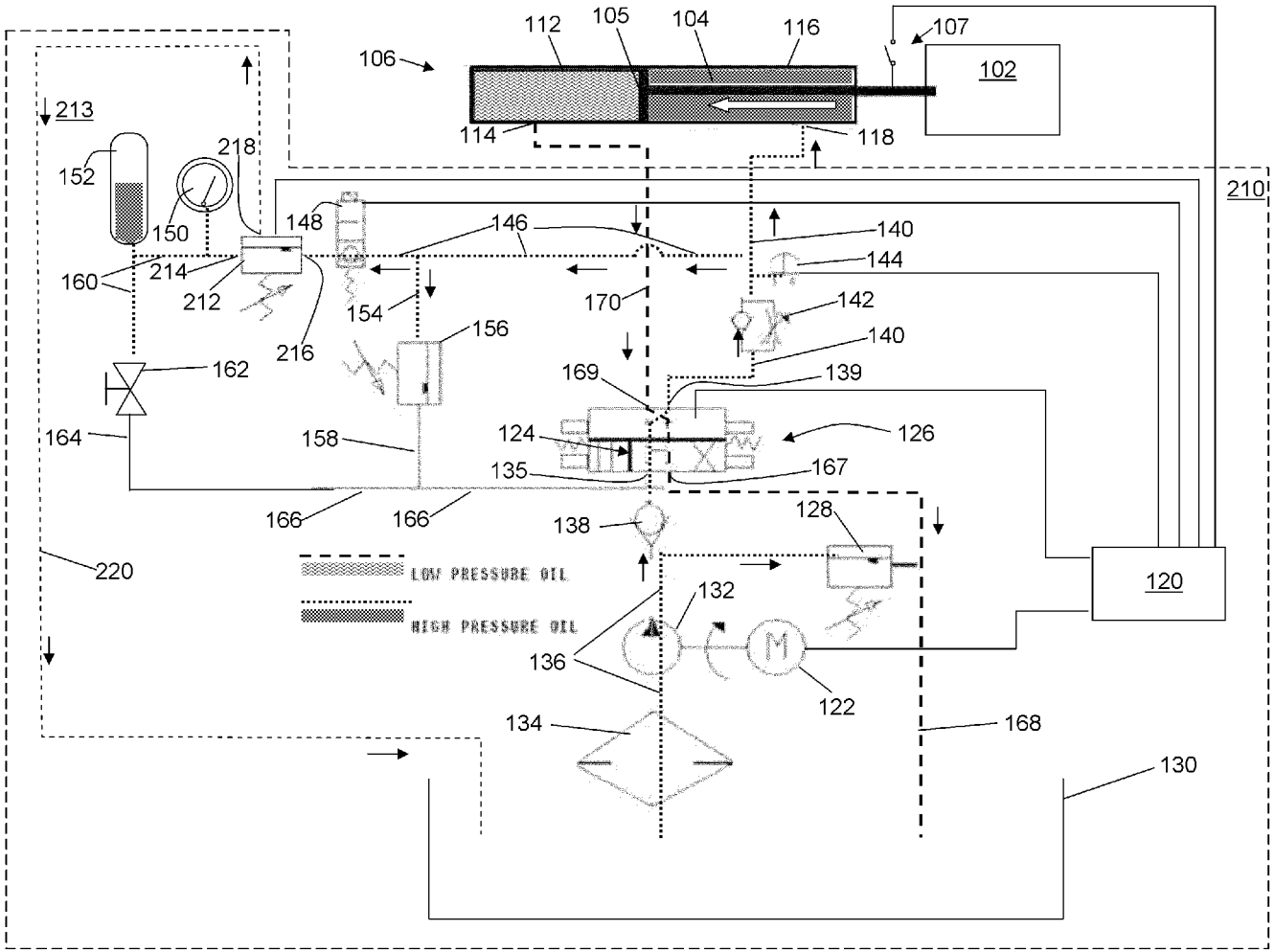
FIG. 9 shows a hydraulic circuit according to the present invention having an additional accumulator relief valve that drains to the main reservoir to prevent internal and external fluid leaks and extend the useful lifetime of the system components.

FIG. 9 shows a modified hydraulic circuit 210, which includes the components of the hydraulic circuit 110 described above with respect to FIGS. 3-8, and further incorporates an external pressure relief valve 212 that drains to the main reservoir 130 via an external hydraulic fluid drain line 213. The external pressure relief valve 212 is a three port valve, and has a maximum pressure set point of, for instance, 2000 psi in a system that operates as described herein with reference to FIGS. 3-6 for a crash barrier 102 that raises in a normal-UP mode in about 3 to 5 seconds, lowers in a normal-DOWN mode in 6 to 8 seconds, and raises in an emergency-UP mode in 1 to 1.5 seconds. In particular, the external pressure relief valve 212 includes a first port 214 connected to a side of the emergency hydraulic fluid line 160 with the pneumatic container 152, a second port 216 connected to a side of the emergency hydraulic fluid line 160 with the emergency-UP solenoid check valve 148, and a third port 218 for release of excess pressure through the external hydraulic fluid drain line 213 and recycled the hydraulic fluid to the hydraulic reservoir 130.

The pressure set point of the external accumulator relief valve 212 is higher than the pressure set points of other safety components of the system, so that there will be no affect on the normal or emergency operations of the hydraulic circuit 210. In the event of an overpressure condition, the accumulator relief valve 212 will depressurize the system automatically. Therefore, the need to depressurize the system through the emergency hydraulic fluid drain valve 162 is obviated, and the use of the drain valve 162 can be limited to depressurizing the system for system calibration.

As will be understood from the preceding description, the external pressure relief valve 212 protects system components, such as the pressure gauge 150, which in conventional systems without the external pressure relief valve 212 is prone to being damaged, referred to in the industry as a gauge blowout. Furthermore, use of the emergency hydraulic fluid drain valve 162 is minimized. In addition, leaks are prevented, thereby avoiding the detriments associated with oil spillage, such as wasted oil and environmental damage.

According to certain embodiments, the three port external pressure relief valve 212 is electronically isolated, i.e., decoupled, from the PLC 120. That is, the external pressure relief valve 212 functions independently and without the requirement to receive instructions from the PLC 120. According to additional embodiments, the external pressure relief valve 212 is constructed and arranged to allow passage of fluid when the pressure of the hydraulic fluid in the emergency hydraulic fluid line 160 exceeds a predetermined value under control of a mechanical actuator without electronic intervention. According to further embodiments, the external pressure relief valve 212 is constructed and arranged to allow passage of fluid when the pressure of the hydraulic fluid in the emergency hydraulic fluid line 160 exceeds a predetermined value under control of a mechanical actuator without electronic intervention, and is electronically isolated from the PLC 120. According to still further embodiments, the external pressure relief valve 212 is constructed and arranged to allow passage of fluid when the pressure of the hydraulic fluid in the emergency hydraulic fluid line 160 exceeds a predetermined value under control of an electro-mechanical actuator. According to yet further embodiments, the external pressure relief valve 212 is constructed and arranged to allow passage of fluid when the pressure of the hydraulic fluid in the emergency hydraulic fluid line 160 exceeds a predetermined value under control of an electro-mechanical actuator, and is electronically isolated from the PLC 120.

The method and system of the present invention have been described above and in the attached drawings; however, modifications will be apparent to those of ordinary skill in the art and the scope of protection for the invention is to be defined by the claims that follow.

The invention claimed is:

1. A crash barrier system comprising:

a hydraulic actuator driven piston having a first end structurally connected to a crash barrier and a second end that is a movable compartment wall between a first variable volume fluid compartment having a first fluid port and an associated first fluid line, and a second variable volume fluid compartment having a second fluid port and an associated second fluid line;

a hydraulic fluid reservoir;

a hydraulic pump in fluid communication with the hydraulic fluid reservoir and a pressurized fluid delivery line;

a hydraulic fluid drain line in fluid communication with the hydraulic fluid reservoir;

a directional control valve sub-system constructed and arranged in fluid paths between the hydraulic fluid ports of the hydraulic actuator compartments via a first directional control valve port and second directional control valve port, and the pressurized fluid delivery line via a third directional control valve port and the hydraulic fluid drain line via a fourth directional control valve port, a crash emergency barrier rise sub-system in selective fluid communication with the second fluid line via an accumulator line, the crash emergency barrier rise sub-system including an emergency hydraulic fluid line having a recharged state in which hydraulic fluid at a pressure greater than the pressure of hydraulic fluid in the accumulator line, a pneumatic container containing hydraulic fluid and pressurized gas, and an emergency-UP solenoid check valve connected between the emergency hydraulic fluid line and the accumulator line, the emergency-UP solenoid check valve having an open position in which higher pressure hydraulic fluid from the recharged emergency hydraulic fluid line passes to the accumulator line and a closed position in which either recharged hydraulic fluid in the emergency hydraulic fluid line is isolated from the accumulator line, or hydraulic fluid in the accumulator line passes to the emergency hydraulic fluid line to attain the recharged state; and a programmable logic controller in electronic communication with the directional control valve sub-system, the hydraulic pump and the emergency-UP solenoid valve; and an external accumulator relief valve in fluid communication with the emergency hydraulic fluid line having a first port connected to a side of the emergency hydraulic fluid line with the pneumatic container, a second port connected to a side of the emergency hydraulic fluid line with the emergency-UP solenoid check valve, and a third port for release of excess pressure.

2. The system as in claim 1, wherein the directional control valve sub-system includes a first conduit arrangement in which pressurized hydraulic fluid is passed through the pressurized fluid delivery line, the third directional control valve port, the first directional control valve port and into the first hydraulic fluid actuator compartment, and drained hydraulic fluid is passed from the second hydraulic fluid actuator compartment to the second directional control valve port, the fourth directional control valve port and into the hydraulic reservoir; and a second conduit arrangement in which pressurized hydraulic fluid is passed through the pressurized fluid delivery line, the third directional control valve port, the second directional control valve port and into the second hydraulic fluid actuator compartment, and drained hydraulic fluid is passed from the first hydraulic fluid actuator compartment to the first directional control valve port, the fourth directional control valve port and into the hydraulic reservoir.

3. The system as in claim 2, wherein the directional control valve sub-system further includes a third conduit arrangement in which the first directional control valve port and the second directional control valve port are closed to prevent backflow of hydraulic fluid from the first fluid line and the second fluid line into the hydraulic fluid reservoir.

4. The system as in claim 2, wherein the directional control sub-system comprises a solenoid having at least a first position corresponding to the first conduit arrangement, and a second position corresponding to the second conduit arrangement.

5. The system as in claim 3, wherein the solenoid of the up/down solenoid directional control valve assembly further includes a third position in which all paths are blocked.

6. The system as in claim 5, wherein the directional control sub-system comprises a solenoid having at least a first position corresponding to the first conduit arrangement, a second position corresponding to the second conduit arrangement, and a third position corresponding to the third conduit arrangement.

7. The system as in claim 2, wherein, during normal operations of moving the crash barrier to the UP position, the programmable logic controller signals the hydraulic pump to activate and signals the directional control valve sub-system to be configured in the second conduit arrangement, thereby causing pressurized fluid to enter the second fluid line and the second hydraulic fluid port of the second variable volume fluid compartment, causing the piston to move in a direction that results in displacement of the crash barrier to the UP position, and causing fluid to drain from the first fluid line to the hydraulic reservoir, during normal operations of moving the crash barrier to the DOWN position, the programmable logic controller signals the hydraulic pump to activate and signals the directional control valve sub-system to be configured in the first conduit arrangement, thereby causing pressurized fluid to enter the first fluid line and the first hydraulic fluid port of the first variable volume fluid compartment, causing the piston to move in a direction that results in displacement of the crash barrier to the DOWN position, and causing fluid to drain from the second fluid line to the hydraulic reservoir;

wherein, during emergency operations of moving the crash barrier to the UP position, the programmable logic controller signals the emergency-UP solenoid check valve to open thereby causing hydraulic fluid from the pressurized vessel under pressure of gas contained in the pressurized vessel to be forced into the second fluid line and the second hydraulic fluid port to raise the crash barrier; and during conditions in which the pressure of the hydraulic fluid in the emergency hydraulic fluid line exceeds a predetermined value, hydraulic fluid is released through the third port to maintain the pressure in the emergency hydraulic fluid line at or below the predetermined value.

8. The system as in claim 1, wherein the external accumulator relief valve is electronically isolated from the programmable logic controller.

9. The system as in claim 8, wherein the external accumulator relief valve is constructed and arranged to allow passage of fluid through the third port when the pressure of the hydraulic fluid in the emergency hydraulic fluid line exceeds a predetermined value under control of a mechanical actuator without electronic intervention.

10. The system as in claim 1, wherein the external accumulator relief valve is constructed and arranged to allow passage of fluid through the third port when the pressure of the hydraulic fluid in the emergency hydraulic fluid line exceeds a predetermined value under control of a mechanical actuator without electronic intervention.

11. The system as in claim 8, wherein the external accumulator relief valve is constructed and arranged to allow passage of fluid through the third port when the pressure of the hydraulic fluid in the emergency hydraulic fluid line exceeds a predetermined value under control of an electromechanical actuator.

12. The system as in claim 1, wherein the external accumulator relief valve is constructed and arranged to allow passage of fluid through the third port when the pressure of the hydraulic fluid in the emergency hydraulic fluid line exceeds a predetermined value under control of an electromechanical actuator.

13. The system as in claim 1, wherein the external accumulator relief valve is in fluid communication with the hydraulic reservoir via an emergency hydraulic fluid drain line in fluid communication with the third port.

* * * * *